US008810655B2

(12) United States Patent
McQueen

(10) Patent No.: US 8,810,655 B2
(45) Date of Patent: Aug. 19, 2014

(54) SURVEILLANCE SYSTEM

(76) Inventor: Dwight McQueen, Oakland, CA (US)

( * ) Notice: Subject to any disclaimer, the term of this patent is extended or adjusted under 35 U.S.C. 154(b) by 1769 days.

(21) Appl. No.: 11/746,559

(22) Filed: May 9, 2007

(65) Prior Publication Data

US 2008/0278321 A1 Nov. 13, 2008

(51) Int. Cl.
*G08B 13/14* (2006.01)

(52) U.S. Cl.
USPC ..... 348/151; 348/375; 340/568.1

(58) Field of Classification Search
USPC ..... 348/151
See application file for complete search history.

(56) References Cited

U.S. PATENT DOCUMENTS 5,345,218 A * 9/1994 Woods et al. ..... 340/479
5,345,219 A * 9/1994 Rogers ..... 340/568.2
2004/0080627 A1* 4/2004 Kroll et al. ..... 348/221.1
2006/0028548 A1* 2/2006 Salivar et al. ..... 348/143
2007/0009104 A1* 1/2007 Renkis ..... 380/270

* cited by examiner

*Primary Examiner* — Wing F Chan
*Assistant Examiner* — Andrew Woo
(74) *Attorney, Agent, or Firm* — O'Melveny & Myers LLP

(57) ABSTRACT

A surveillance system for preventing the theft of clothing. In particular, a clothing rack includes a surveillance system and an indicator to warn customers that they are under surveillance. In one embodiment, the clothing rack includes an elongated hollow body adapted to support at least one hanger by its hook, at least one bore extending through a wall of the elongated hollow body to provide a filed of vision and an indicator. A camera is enclosed within the elongated hollow body of the clothing rack and positioned such that the camera lens is substantially aligned with the bore in the hollow rigid body. A surveillance monitor displays the views from the cameras and, in one embodiment, records such views.

20 Claims, 3 Drawing Sheets

SURVEILLANCE SYSTEM

FIELD OF THE INVENTION

The present invention generally relates to a surveillance system. More specifically, the present invention comprises a clothing rack surveillance camera and system for preventing the theft of clothes from retail stores.

BACKGROUND OF THE INVENTION

Shoplifting is a major problem for operators in all segments of the retail industry. Shoplifting alone costs retailers over $18 billion annually in terms of loss of gross sales and the cost of prosecuting apprehended thieves. The number of incidents that go unreported, or even undocumented, by retail stores far surpasses the number of reported or documented cases.

In 2004, a survey indicated that more than 750,000 shoplifting apprehensions took place in just twenty-seven large retail companies. These companies have more than 12.000 stores and a combined 2004 annual sales in excess of $400 billion. Some shoplifter-related facts from this survey are (i) in 2004, survey participants apprehended 689,000 shoplifters, reflecting an increase of 5% over the number of shoplifter apprehensions in 2003, (ii) dollars recovered from shoplifting apprehensions totaled over $70.0 million in 2004, a 1.50% increase over 2003 recoveries ($70 million), and (iii) the dollars recovered from shoplifters where no apprehension was made increased for the eighth consecutive year.

To combat these losses, merchants have sometimes had to take extreme measures to control shoplifting. Most large retailers employ plain-clothes floor detectives to observe customers as they shop. Plain clothes floor detectives alone are not enough of a deterrent because they are seemingly invisible to the customer. Many stores use video surveillance cameras and electronic article surveillance (EAS) devices attached to their products that cause alarms to go off if not deactivated by the cashier. Others retailers physically secure expensive and high theft items, like small leather items, perfume, and cosmetics in locked enclosures. Other retailers use cables or hanger locks that require the assistance of a sales associate to unlock the expensive item of clothing before you can inspect it.

There have been, over the years, many technological advances in the prevention of shoplifting. EAS, closed circuit television cameras and exception monitoring has been employed in some retailers but can be expensive. In many cases due to the cost, technology such as EAS is implemented to protect only high-end merchandise.

For example, to prevent theft, retail stores often contain multiple ceiling-mounted surveillance cameras. The surveillance camera may be stationary (e.g., mounted on a pole or extension device) or mounted to a servomotor device and is often hidden within a colored dome to hide the camera. To cover as much of the store as possible with one camera, the surveillance camera is often mounted to a servomotor that rotates the camera. The servomotor rotates the camera through a predetermined range of motion (e.g. 30°) at a specific rate of motion.

If the camera is located within a colored dome, consumers within the retail store cannot tell which part of the store the camera is currently surveying. However, the servomotor often makes a noise as it is rotating the camera. Experienced shoplifters listen for the sound of the servomotor operating and determine the position of the camera based on the motor noise. If the servomotor takes 3-5 seconds to rotate the camera through the entire range of motion, the shoplifter can time the noise of the servomotor to coordinate his or her shoplifting white the camera is not surveying that specific section of the store. Thus, retail stores lose merchandise to shoplifters.

Therefore, there is a need for an improved surveillance system and/or deterrent to prevent or reduce shoplifting. The present invention provides such a system.

SUMMARY OF THE INVENTION

One aspect of the present invention is to provide a surveillance system for minimizing shoplifting within a retail store. In one embodiment, the clothing rack body includes at least one bore so that a camera, hidden within the body of the clothing rack, may have a field of view. The camera transmits its image (analog or digital) to a surveillance monitor. A retail store employee or security guard may then observe all camera images on a surveillance monitor. In one embodiment, all camera images are displayed simultaneously on the monitor. In another embodiment, the store employee or security guard must select which images to display on the monitor.

Another aspect of the present invention is to make consumers aware that the retail store has a surveillance system. In one embodiment, the clothing rack body includes an indicator that is visible to the consumer. In one embodiment, the indicator comprises an LED. The LED may remain lit or may, for example, intermittently turn on and off. In another embodiment, the indicator may comprise a fluorescent or incandescent light source.

Yet another aspect of the present invention is to provide a surveillance system on the floor level of the retail store. In one embodiment, a floor-supported clothing rack includes one or more surveillance cameras concealed within the clothing rack body. If more than one clothing rack includes such a camera, a network of concealed surveillance cameras monitors the retail store. The network of surveillance cameras reduces or eliminates the "blind-spots" that cannot be avoided with conventional ceiling-based surveillance cameras. In one embodiment the cameras transmit their image wirelessly to a monitor.

DETAILED DESCRIPTION OF THE INVENTION

Figure 1:
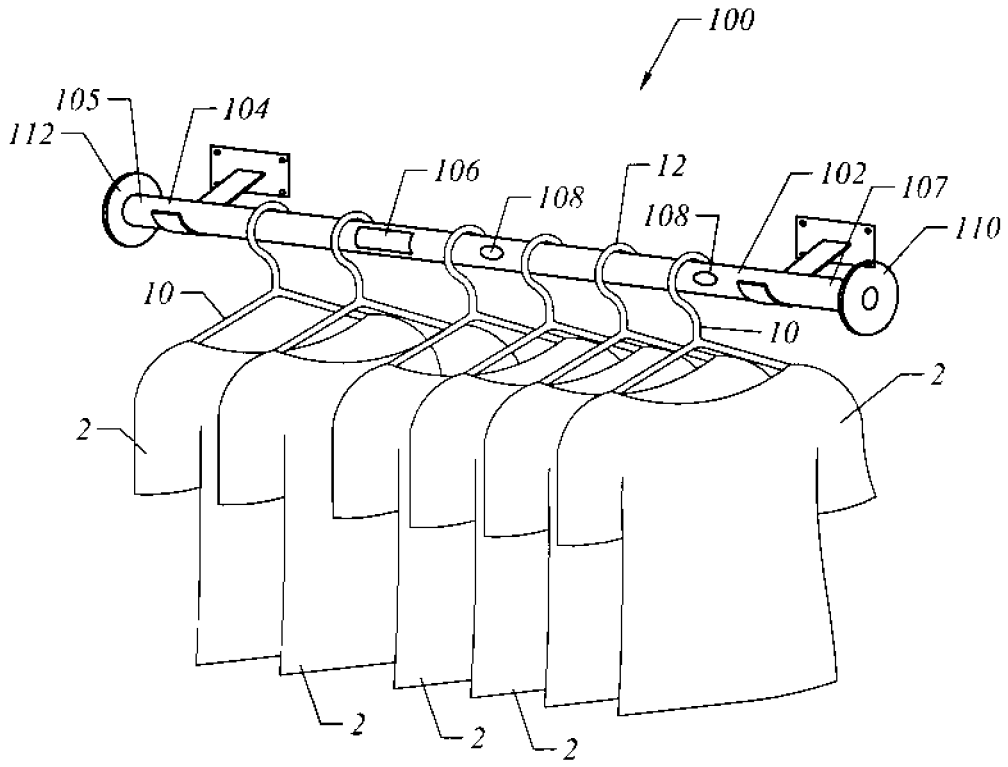
FIG. 1 provides an isometric view of an embodiment of the present invention.

The present invention generally comprises a shoplifting deterrence system for retail stores. FIG. 1 illustrates one embodiment of a clothing rack 100. The clothing rack 100 is shown as a clothing rack body 102 supported by two brackets extending from a wall of a retail store. The clothing rack 100 is shown in this configuration for explanatory purposes only and may be include other configurations.

In this embodiment, the clothing rack 100 comprises an elongated, cylindrical body 102 having a first end 105 and a second end 107. The body 102 may, of course, comprise other shapes such as, but not limited to, square, rectangular, triangular, etc.—as long as the clothing rack body 102 may support one or more clothing hangers 10. The clothing rack body 102 may comprise any length and does not have to be linear. In a preferred embodiment, the clothing rack body 102 comprises a hollow structure (for reasons described hereinafter), but the body may also comprise a solid cross section.

FIG. 1 illustrates that the clothing rack body 102 includes an indicator 106 and two bores or camera windows 108. Of course, the clothing rack body 102 may include any number of indicators 106 and camera windows 108. The indicator 106 is intended to provide a visible display or warning light to a consumer that the clothing rack 100 includes a surveillance system (or at least provides the impression that it does). The indicator 106 is preferably illuminated and may comprise any color. For example, the indicator 106 may comprise a red light emitting diode that blinks at predetermined intervals. Or the indicator 106 may comprise a red light source that remains illuminated at all times (not blinking). Regardless, the indicator 106 should be noticeable to the consumer. As will be described in more detail later, the indicator 106 may be hardwired to an electrical source or may be powered by a battery.

In the embodiment whereby the clothing rack body 102 is hollow, each camera window 108 extends through the wall of the hollow body 104. The camera window may comprise any size or shape, and if the clothing rack body 102 includes more than one window 108, the camera windows do not all have to be the same size and shape. The camera window 108 provides a port to view through from the inside of the clothing rack body 102. Thus, each camera window 108 may be located at any elevation along the wall. For example, the camera windows 108 shown in FIG. 1 exist at the mid-level elevation of the clothing rack body wall. These two camera windows 108 provide a point of view from inside the body 102 that is looking substantially horizontal out of the clothing rack body 102. A camera window 108 may also exist at a lower elevation in the clothing rack body 102 such that the point of view form the inside of the clothing rack body 102 is slightly angled towards the floor of the retail store. For a clothing rack body 102 with multiple cameras, it might also be preferable for the camera windows 108 to each provide a different point of view. For example, the clothing rack body 102 may include one camera window 108 providing a horizontal point of view, a second camera window 108 providing a point of view that is angled upward, while a third camera window 108 provides a point of view that is angled slightly downward. As will be discussed in more detail later, the shape and size of the camera window 108 is dependant, in part, on the type of surveillance camera located inside the clothing rack body 102.

Figure 2:
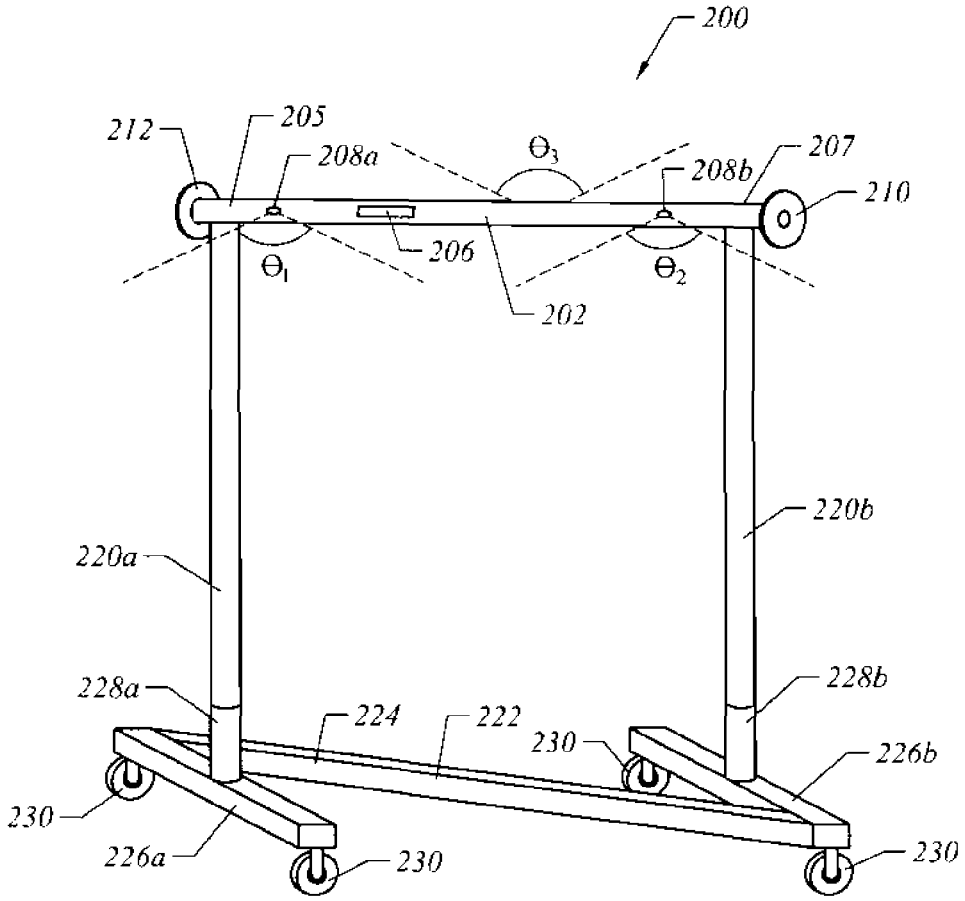
FIG. 2 provides an isometric view of another embodiment of the present invention.

A retail store often has several clothing racks. Some of the clothing racks are mounted on the walls of the retail store. And free-standing clothing racks are often spread throughout the floor of the retail store. FIG. 1 illustrates clothes 2 for sale in the retail store displayed on a clothing rack 100 that is supported by a pair of brackets mounted to the retail store wall. The clothing 2 illustrated in FIG. 2 is shirts. Of course, any type of clothing could be placed in the hanger (e.g., pants dresses, coats, etc.). FIG. 1 illustrates one embodiment where the clothing 2 is placed on a hanger 10 that hangs by a hook 12 from the clothing rack body 102. The clothing rack body 102 may comprise any material (e.g., plastic, aluminum, etc.) as long as the material is rigid enough so that the clothing rack body 102 may support the hangers 10.

FIG. 1 illustrates that the clothing rack body 102, in this embodiment, includes a pair of end caps 110 and 112. The end caps are not necessary, but make the installation and replacement of the cameras and indicators easier. The end caps 110 and 112 are preferably secured to the clothing rack body 102 so that a customer could not tamper with the surveillance system installed in the clothing rack body 102. For example, the end caps 110 and 112 may be press fit onto the rack body 104. The end caps 110 and 112 may be secured to the body by other fasteners (e.g. bolts, screws, etc.). The ends 105 and 107 of the clothing rack body 102 may also be secured to the clothing rack body 102, eliminating the end caps. For example, the interior wall of the ends 105 and 107 may include a female thread that allows the ends to screw on/off of the male thread of the exterior wall of the clothing rack body 102. Again, it is preferable that the clothing rack body 102 provide an enclosed, secure environment for the cameras to prevent unwanted tampering with the surveillance system.

FIG. 2 illustrates a moveable clothing rack 200. The clothing rack 200 includes a floor-standing frame 222 to support the clothing rack body 202 so that the clothes may be displayed out on the retail floor. The frame 222 may have many different configurations. For discussion purposes only. FIG. 2 illustrates that the frame 222 includes a central member 224, connected to two end members 226*a* and 226*b* and two posts 228*a*, 228*b* extending upward from each end member 226*a*, 226*b*. The frame 222 is supported by four rollers 230. The clothing rack 200 includes two vertical members 220*a*, 220*b*, each member 220 inserted into a post 228.

The clothing rack body 202 is supported by the two vertical members 220*a*, 220*b*. In this embodiment, the clothing rack body 202 includes one indicator 206 and three camera windows 208. FIG. 2 illustrates a first camera window 208*a* and a second camera window 208*b* on the same side of the clothing rack body 202. The third camera window is not visible in FIG. 2, but its located on the opposite of the clothing rack body 202 as the camera windows 208*a* and 208*b*. The field of vision through the first camera window 208*a* is shown as θ1. The field of vision through the second camera window 208*b* is shown as θ2. The field of vision through the third camera window 208 is shown in FIG. 2 as θ3. The view angle θ out of each camera window 208 may vary.

The positioning of the camera windows 208 shown in FIG. 2 is for illustration purposes only. All the camera windows 208 may be located on one side of the clothing rack body 202. A configuration with all camera windows 208 along one side of the clothing rack body 202 may be preferred if the clothing rack 200 is going to be placed against a wall or in a corner of the retail store. Placing a camera window 208 on both sides of the clothing rack body 202 may be preferable if the clothing rack 200 will be placed in the middle of the retail store floor. Camera windows 208 on both sides of the clothing rack body 202 provides the ability to monitor more than one side of the clothing rack 200. The ability to see in two directions would make it more difficult for a shoplifter to take a piece of clothing from the clothing rack 200 without being noticed.

Like the indicator 106 shown in FIG. 1, the indicator 206 comprises a light emitting diode, of any color, that remains lit or that flashes intermittently. The indicator 206 is not required as part of the clothing rack 200. The indicator 206 provides a visible deterrent to the customers within the retail store that a surveillance system may be operable within the store. Such an indicator 206 may provide enough of a deterrent to shoplifters that cameras within the clothing rack body 202 may not be necessary. For example, the clothing rack body 202 may include an indicator 206 and a dummy camera positioned behind each camera window 208 so that it appears as if there are cameras within the clothing rack 200. Or, to hide the camera from the customer's view each camera window 208 may be covered by material (e.g., one-way vision plastic) modeled to look like a fastener (e.g., bolt screw, pin, etc.). The material preferably masks the camera window so that customers cannot detect if there is a camera window 208 and/or camera within the clothing rack body 202.

Each camera is positioned within the clothing rack body 202 such that the camera lens (not shown) is substantially aligned with the camera window 208. To prevent the camera from moving within the clothing rack body 202, the camera is secured to the interior wall of the clothing rack body 202. The camera window 208 is preferably a small diameter hole in the clothing rack body wall. This way, the camera body is concealed within the clothing rack body 202, yet the camera lens has a clear line-of-sight through the camera window 208. The camera window 208 may also comprise a large diameter hole (e.g., larger than the diameter of the camera lens). In this embodiment, the camera window 208 is preferably concealed with the transparent material described above to conceal the camera body.

Many types of cameras may be installed within the clothing rack body 202. By way of example only, the camera may comprise a mini spy pinhole camera manufactured by Weldex. As discussed above, the camera window 208 may be larger than the camera lens. In this case, after the camera is installed, a cover (e.g., colored glass, transparent material that looks like a bolt, etc.) may be placed over/within the camera window 208. The cover must not, of course, degrade the camera image and may, for example, look like the top of the head of a screw. This way, a consumer in the retail store cannot detect that the clothing rack 200 includes a surveillance camera.

If the camera requires a power supply, the power supply may be contained within the clothing rack body 202 of the clothing rack 200. In the FIG. 1 embodiment, the power supply may be located on the other side of the wall (that the brackets are affixed to). Thus, the power cord may through the wall, along the bracket into the clothing rack body 202 and into the camera. The bracket may also comprise a hollow structure to function as a conduit for the power cord, which would conceal the power cord from the view of the retail customer. The camera's transmitter/transceiver may be located within the clothing rack body 202 or elsewhere.

The camera may also comprise a wireless device. By way of example only, the camera may comprise the CA12 camera manufactured by Cantek Technologies. The receiver for the camera may be located in the clothing rack body 202 or elsewhere within the retail store. For example, in FIG. 1, the receiver may be located behind the retail store wall or any other part of the store within the range of the camera's signal.

Non-operational or "dummy" cameras may also be installed within the body 204 of the clothing rack 200 to provide the effect that the clothing rack 200 includes a surveillance system. In this case, the non-operational camera(s) would be installed within the clothing rack body 202 such that the dummy camera lens is visible through the camera window 208. A consumer browsing through the clothes 8 hanging on the clothing rack 200 will notice the dummy camera lens but not know whether the camera is operational. Thus, the non-operational camera also provides a deterrent to shoplifters.

The operation of the indicator 206 and/or the camera may be configured by the retail store. For example the retail store could set the indicator 206 to blink intermittently or remain lit at all times. Similarly, the retail store may set the camera to continuously capture video images (e.g., 7 days a week, 24 hours a day) or record video for certain intervals (e.g. only capture video during busy shopping hours). Multiple clothing racks within the retail store with blinking indicators 106, 206 may be distracting to the consumers. Thus, it may be preferable to set the indicator 106, 206 to operate only when activated by a motion sensor (not shown) contained within the clothing rack. In this embodiment, the indicator 106, 206 would remain non-operational (e.g., unlit) until a consumer triggered the motion sensor. When the sensor detects a person close to the clothing rack, the indicator 106, 206 will begin to function (e.g., illuminate or begin to blink for a predetermined amount of time). Motion sensors are conventional electronic devices known to one skilled in the art and therefore do not require further disclosure herein. Each motion sensor may be set to a different sensitivity level.

Figure 3:
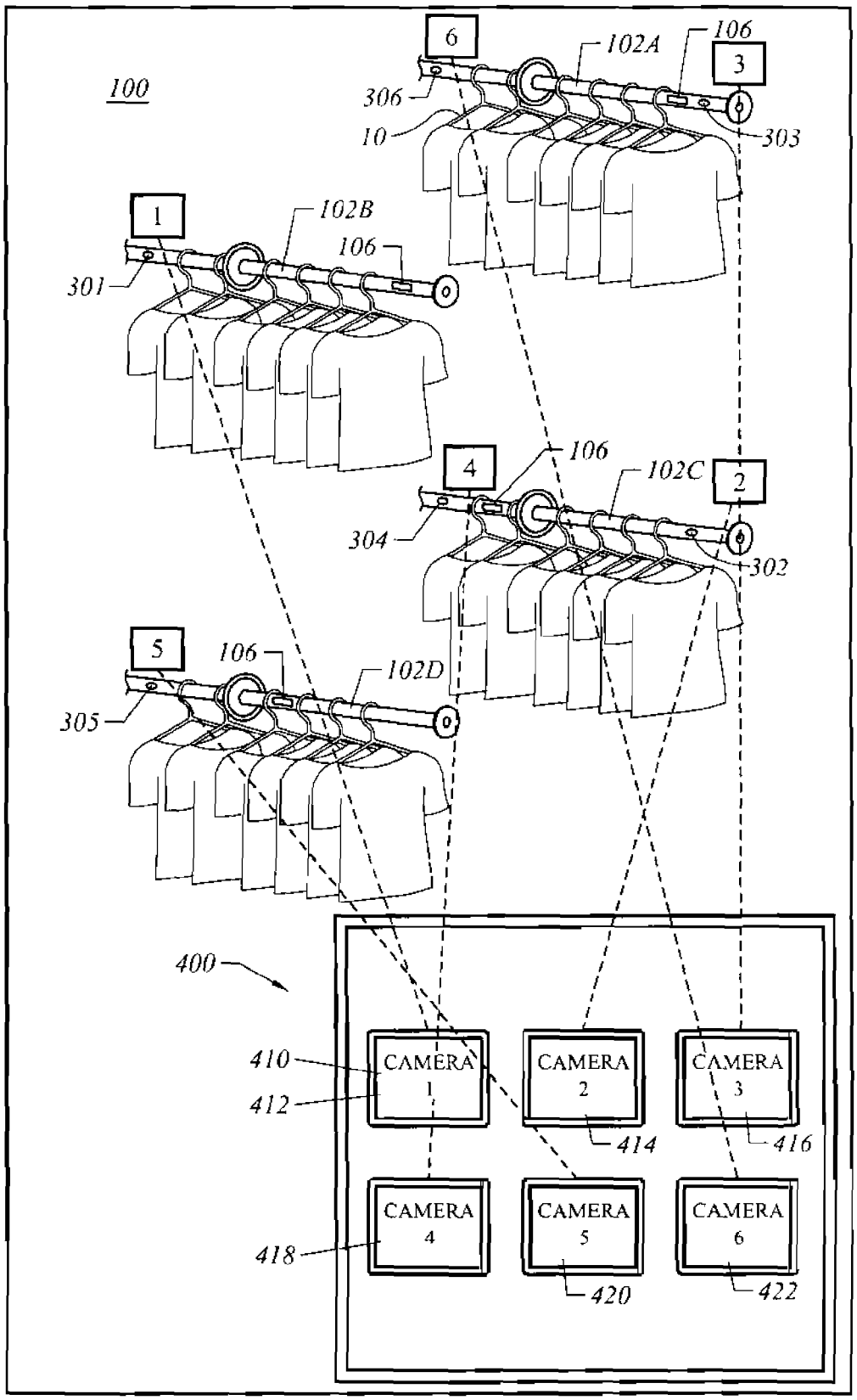
FIG. 3 provides a schematic view of an embodiment of a security system, according to the present invention.

FIG. 3 illustrates that the cameras from multiple clothing racks may be viewed by a single surveillance monitor 300. FIG. 3 illustrates four clothing racks 102A, 102B, 102C and 102D installed within a retail store. Of course any combination of clothing racks 102, clothing racks 200 and cameras 300 may be located within the retail store and the surveillance monitor 400 may view the image of any of these cameras. In the FIG. 3 embodiment of a surveillance system 100 the clothing racks include a combined total of six surveillance cameras. Clothing rack 102A includes a first camera 303 and a second camera 306. The clothing rack 102B includes one camera 301. The clothing rack 102C includes a first camera 302 and a second camera 304. The clothing rack 102D includes one camera 305.

FIG. 3 illustrates one example of a surveillance system whereby a single surveillance monitor 400 is able to view the images from each camera. The surveillance monitor 400 includes six monitor screens 410. Each screen 410 displays the image from a single camera. Thus, the images from all six cameras may be viewed simultaneously. For example, monitor screen 412 displays the image received by the camera 301 in clothing rack 102B; monitor screen 414 displays the image received by the camera 402 in clothing rack 102C; monitor screen 416 displays the image received by the camera 303 in clothing rack 102A; monitor screen 418 displays the image received by the camera 304 in clothing rack 102C, monitor screen 420 displays the image received by the camera 305 in clothing rack 102D; and monitor screen 422 displays the image received by the camera 306 in clothing rack 102A.

The surveillance monitor 400 is not required to have a monitor screen 410 dedicated for each camera. The surveillance monitor 400 may comprise any conventional monitor known within the art. For example, the monitor 400 may comprise a single screen divided into multiple windows for simultaneously viewing multiple images (e.g., Shenzhen H2 Electronic Co., Ltd 20" LCD Surveillance Monitor). The monitor 400 may also comprise a single screen for viewing a single camera image (e.g., Hong Kong Highline Trading Co., Ltd 21" Surveillance Color Monitor) and a multiplexer may control which image is displayed on the monitor at any given time period.

Clothing rack 102A includes an indicator 106 and two cameras 303 and 306. The two cameras are shown on opposite ends of the clothing rack body. However, the cameras may be placed anywhere along the clothing rack body. In this embodiment, camera 303 transmits a signal 3 to camera 3 (labeled 416) of the monitor 400 and camera 306 sends its signal to camera 6 (labeled 422) of the monitor 400.

Clothing rack 102B includes an indicator 106 and one camera 301. The camera is shown on the left end of the clothing rack body. However the camera may be placed anywhere along the clothing rack body. In this embodiment, camera 301 transmits a signal 1 to camera 1 (labeled 412) of the monitor 400.

Clothing rack 102C includes an indicator 106 and two cameras 302 and 304. Again, the two cameras are shown on opposite ends of the clothing rack body. However, the cameras may be placed anywhere along the clothing rack body. In this embodiment, camera 302 transmits a signal 2 to camera 2 (labeled 414) of the monitor 400 and camera 304 sends its signal to camera 4 (labeled 418) of the monitor 400.

Clothing rack 102D includes an indicator 106 and one camera 305. The camera 105 is shown on the left end of the clothing rack body. However the camera may be placed anywhere along the clothing rack body. In this embodiment, camera 305 transmits a signal 5 to camera 5 (labeled 420) of the monitor 400.

Each camera image may be transmitted by any method known within the surveillance industry. In one embodiment, each camera comprises a wireless device that transmits the signal to a transceiver within the retail store, which then forwards the signal to the surveillance monitor 400. The transceiver may be located anywhere within the retail store (e.g., ceiling mounted, wall mounted, etc.). Both the camera and transceiver may transmit either infrared or radio frequency (e.g. IEEE 802.11b. IFEE802.11g, etc.) signals. Infrared transmission requires a line-of-sight between the camera transmitter and the transceiver. Transmitting radio frequency signals provides the retail more flexibility where to place the transceiver. It is also within the scope of the invention for each camera to be hard-wired directly to the surveillance monitor 400.

It should be appreciated that the above-described surveillance system is for explanatory purposes only and that the invention is not limited thereby. Having thus described a preferred embodiment of a surveillance system and method of surveying, it should be apparent to those skilled in the art that certain advantages of the within system have been achieved. It should also be appreciated that various modifications, adaptations, and alternative embodiments thereof may be made within the scope and spirit of the present invention.

I claim:

1. A surveillance system comprising:

a clothing rack, including:

an elongated hollow body having a first end and a second end, said elongated hollow body adapted to support at least one hanger; and at least three windows;

a first camera enclosed within said elongated hollow body, said first camera having a first lens substantially aligned with a first one of said at least three windows;

a second camera enclosed within said elongated hollow body, said second camera having a second lens substantially aligned with a second one of said at least three windows; and an indicator enclosed within, said elongated hollow body, said indicator being substantially aligned with a third one of said at least three windows;

wherein said indicator, which is operated independently of said first and second cameras, is illuminated regardless of whether said first or second camera is recording, and functions to warn a consumer of said surveillance system.

2. The system as recited in claim 1, wherein said indicator is configured to blink and a predetermined interval.

3. The system as recited in claim 2, wherein said indicator comprises a light emitting diode.

4. The system as recited in claim 1, wherein said indicator is configured to illuminate in a steady-state as long as power is applied to said indicator.

5. The system as recited in claim 2, wherein said elongated hollow body comprises a rigid material.

6. The system as recited in claim 5, wherein said elongated hollow body comprises a circular cross section.

7. The system as recited in claim 2, wherein said camera transmits a signal representing the image captured by the camera.

8. The system as recited in claim 7, wherein said signal is transmitted wirelessly.

9. The system as recited in claim 1, further including a surveillance monitor system for receiving said signal transmitted by said camera and displaying the image.

10. A surveillance system, comprising:

a clothing rack, including:

an elongated hollow body having a first end and a second end, said elongated hollow body adapted to support at least one hanger;

at least three windows;

a first camera enclosed within said elongated hollow body behind a first one of said three windows, said first camera transmitting a first signal representing a first image captured by said first camera;

a second camera enclosed within said elongated hollow body behind a second one of said three windows, said second camera transmitting a second signal representing a second image captured by said second camera;

an indicator enclosed within said elongated hollow body behind a third one of said at least three windows; and a surveillance monitor system for receiving said first signal and said second signal transmitted by said first camera and said second camera, respectively, and displaying the first image and the second image;

wherein said indicator, which is operated independently of said first and second cameras, is illuminated regardless of whether said first and second camera are recording, and functions to warn a consumer said first and second cameras are within said elongated hollow body.

11. The surveillance system as recited in claim 10, wherein said indicator is illuminated in response to motion of said consumer.

12. The surveillance system as recited in claim 10, wherein said camera transmits said signal wirelessly to said surveillance monitor.

13. The surveillance system as recited in claim 10, wherein said camera is electrically coupled to said surveillance monitor.

14. The system as recited in claim 11, wherein said indicator comprises a light emitting diode.

15. The system as recited in claim 10, wherein said elongated hollow body comprises a rigid material.

16. The system as recited in claim 10, wherein said elongated hollow body comprises a circular cross section.

17. The system as recited in claim 1, wherein said first one of said at least two camera windows is on a first side of said elongated hollow body and said second one of said at least two camera windows is on a second side of said elongated hollow body.

18. The system as recited in claim 1, wherein said first and second ones of said at least two camera windows are on a same side of said elongated hollow body, and are substantially aligned along a horizontal axis.

19. The system as recited in claim 1, wherein said first one of said at least two camera windows is larger than said first camera, allowing said first camera to be inserted into and removed from said elongated hollow body via said first one of said at least two camera windows.

20. The system as recited in claim 10, wherein a first one of said at least two camera windows is larger than said first camera, allowing said first camera to be inserted into and removed from said elongated hollow body via said first one of said at least two camera windows.

* * * * *